United States Patent [19]

Wahren

[11] 4,324,613

[45] Apr. 13, 1982

[54] METHODS AND APPARATUS FOR THE RAPID CONSOLIDATION OF MOIST POROUS WEBS

[76] Inventor: Douglas Wahren, John Ericssonsq. 48, S-652 21 Karlstad, Sweden

[21] Appl. No.: 158,080

[22] Filed: Jun. 10, 1980

Related U.S. Application Data

[63] Continuation of Ser. No. 21,442, Mar. 19, 1978, abandoned.

[30] Foreign Application Priority Data

Mar. 31, 1978 [SE] Sweden ..... 7803672

[51] Int. Cl.[3] ..... D21F 5/02

[52] U.S. Cl. ..... 162/111; 162/206; 162/375; 100/38; 100/93 RP; 34/41; 34/124

[58] Field of Search ..... 162/206, 359, 207, 358, 162/290, 113, 111, 375; 100/38, 93 RP; 165/89, 90, 91; 432/59, 60, 8; 34/41, 114, 122, 123, 116, 124

[56] References Cited

U.S. PATENT DOCUMENTS

| | | | |
|---|---|---|---|
| 3,073,038 | 1/1963 | Dapses | 34/41 |
| 3,178,831 | 4/1965 | Howlett | 34/41 |
| 3,206,869 | 9/1965 | Justos | 34/114 |
| 3,303,576 | 2/1967 | Sissoon | 162/206 |
| 3,560,333 | 2/1971 | Douglas et al. | 162/206 |
| 3,903,961 | 9/1975 | Stanislaw | 165/89 |
| 4,146,361 | 3/1979 | Cirruto | 34/124 |

FOREIGN PATENT DOCUMENTS

| | | |
|---|---|---|
| 1013136 | 7/1977 | Canada . |
| 316075 | 10/1969 | Sweden . |

*Primary Examiner*—William F. Smith

*Attorney, Agent, or Firm*—Brumbaugh, Graves, Donohue & Raymond

[57] ABSTRACT

A moist, porous web is consolidated and dried by running it through the nip between two rotatable rolls, the surface of one of which is heated as it approaches the nip. One side of the web is in direct contact with the surface of the heated roll and the other side faces a permeable surface. The rolls are pressed together under high pressure to transfer heat from the heated roll to the web compressed therebetween to dry the same. The roll surface may be heated by hot gases from a fuel combustion burner or by a liquid medium. The dried and consolidated web may be removed from the heated roll by doctoring or it may be conveyed from the nip between the rolls to apparatus for processing it further.

18 Claims, 4 Drawing Figures

METHODS AND APPARATUS FOR THE RAPID CONSOLIDATION OF MOIST POROUS WEBS

This is a continuation of application Ser. No. 021,442, filed Mar. 19, 1978, abandoned.

BACKGROUND OF THE INVENTION

The present invention relates to the consolidation of porous, moist webs by pressing and drying, and more particularly to new and improved methods and apparatus for consolidating thin fibrous webs, especially soft papers such as toilet and facial tissues, paper towels, and thin printing papers, for example, although it is not limited to such applications.

Moist paper webs are commonly dried by pressing them against heated rolls. For example, in drying with a so-called Yankee dryer, the web is firmly pressed against a steam heated cylinder of large diameter, which must have considerable thickness to withstand the internal pressure and external load. Usually, a dryer or ventilating hood surrounds part of the cylinder periphery to assist in drying the web. In order to meet the high capacity demands of modern tissue machines, cylinders of very large diameter have been used, yet more than 60% of the drying energy comes from the hood. Such machinery is large, costly to build and operate, and occupies considerable space in the plant.

Multicylinder machines have also been used in which the web is first pressed between rolls, together with one or two felts and possibly accompanying wires. The web is usually taken through two to four press nips in order to remove as much water as possible by mechanical means before final consolidation is effected by drying with heat. This is done by pressing the web against steam heated cylinders by web tensioning or with the aid of a felt or wire adjusted to apply a very light load. Drying then takes place partly while the web is being heated on the cylinders and partly by evaporation of water from the web in the open and preferably ventilated draws between the cylinders. The contact pressure between the web and the cylinders, however, must be kept very low if damage to the web is to be avoided, and this limits the heat transfer from the cylinders to the web. Multicylinder machines are therefore very large and long in relation to the production capacity allowed by the dryer section.

It has also been proposed to dry a web of wet fibrous material by running it over externally heated rollers to generate a vapor layer on which the web floats, as disclosed in Canadian Pat. No. 1,013,316. Since the web does not come into direct contact with the heated roller, heat transfer between the web and the rollers is limited.

SUMMARY OF THE INVENTION

It is an object of the invention, accordingly, to provide new and improved methods and apparatus for consolidating and drying moist porous webs that are free from the above-noted deficiencies of the prior art.

According to the invention, drying of a web is effected by transferring heat very rapidly directly to the web under high pressure, instead of conducting it through the cylinder shell to the web. More specifically, heat is supplied to the outer surface of a roll and the heated surface is then pressed under high pressure against the moist web to be consolidated. The heat energy is stored at a high temperature in a thin surface layer of the roll or cylinder, from which it can be extracted very quickly. Moreover, the heat transfer to the web takes place substantially in a press nip where essentially only fibers and water are present and in particularly close contact with the heated roll surface, so that exceptionally high rates of heat transfer can be obtained.

Complex steam supply and condensate drainage facilities are not required and the roll can be constructed very simply and ruggedly of material having suitable thermal properties. Also, the roll surface may be made permeable in any known manner so that any expressed water and generated steam can escape.

By applying relatively high press loads, very high rates of thermal energy flow can be used without causing the web to come loose from the heated roll. In fact, the temperatures and rates of thermal energy flow used for the heated roll are so high as to cause a very rapid, violent and almost explosive generation of steam to take place at the interface between the roll and the moist web. The steam thus formed tends to pass straight through the web, carrying with it any free water remaining in the cavities between the fibers of the web. Thus, the heat transfer between the steam and remaining fibers and water in the web is very effective and cools the steam so effectively that practically all of its heat energy is transferred to the web and the water remaining therein.

While the roll surface can be heated in many different ways, this can most readily be done in an existing paper machine by direct heating of the roll surface with liquid, pulverized, or gaseous fuel, preferably gas or oil. Direct firing with gas enables very great thermal energy flow rates to be achieved simply and inexpensively. Simple burners can be used to attain thermal energy flow rates of up to 1 $MW/m^2$, i.e. twenty to thirty times higher than thermal energy flow rates achievable with a modern Yankee dryer. It is not possible, however, to achieve a 100% transfer of the heat in the gases of combustion, even with the use of special blowing devices and turbulence-generating elements near the roll surface.

Nearly 100% utilization of the heat supplied is effected, according to the invention, by conveying the web, adhered to a felt or wire or a combination thereof, to a suction roll which constitutes the porous roll in the press nip. A hood is disposed around the combustion chamber such that all of the hot gas generated, except for a minimum air surplus or deficit, is drawn through the fibrous web into the suction roll. In this fashion, practically the entire quantity of heat remaining in the combustion gases is utilized for heating and, to some extent, for drying the paper web. Accordingly, almost the entire heat quantity supplied is utilized in the consolidation process without losses.

DESCRIPTION OF REPRESENTATIVE EMBODIMENTS

For a better understanding of the invention, reference is made to the following detailed description taken in conjunction with the accompanying drawings, in which.

Figure 1:
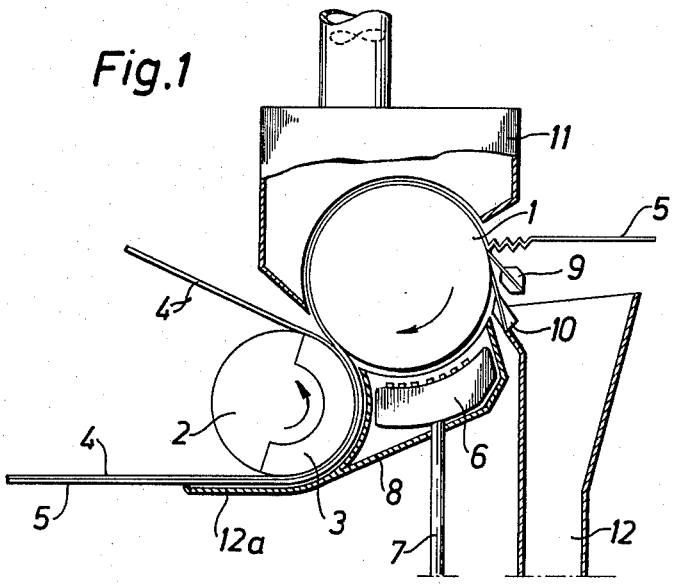
FIG. 1 is a schematic showing of apparatus constructed according to the invention for consolidating a porous, moist web of fibrous material.

In FIG. 1, a heated roll 1 and a suction roll 2 having a suction zone 3 connected to a vacuum source are disposed to form a press nip. The two rolls rotate in the directions indicated by the arrows and conventional means (not shown) are provided for pressing the rolls together under a high linear load (typically, 5–250 kN/m), so that a high pressure in the range 0.1–5 $MN/m^2$ is produced in the press nip. A wire or felt 4 carrying a web 5 runs over the suction roll 2, forming a permeable surface thereon, and then passes through the press nip.

The surface of the roll 1, which can be smooth or patterned, is adapted to be heated by means of gas burners 6 supplied with gaseous fuel through a pipe 7. The gas burners 6 are disposed within a combustion chamber 8 which encloses a sector of the roll 1 in front of the press nip and also has a side wall 12*a* extending along the major part of the vacuum zone 3. Doctor blades 9 and 10 engage the side of the roll 1 opposite the suction roll 2 and are disposed between a broke chute 12 for receiving material doctored off the roll 1 and a hood 11 which encloses the major part of the side of the roll facing away from the combustion chamber 8.

In operation, the web 5 deposited on the felt or wire 4 by direct forming, suction pickup, pressing, etc., is conveyed into the press nip between the rolls 1 and 2. As it passes over the vacuum zone 3 of the suction roll 2, it is subjected to heat from side wall 12*a* and substantially moisture-free hot gases drawn from the combustion chamber 8 into the vacuum zone along the outer surface of side wall 12*a*. Thus, while some of the hot gases from burner 6 reach the web by passing from the combustion chamber 8 about the edge of side wall 12*a*, the burners 6 do not supply a significant proportion of their heat directly to the web prior to the nip area. Adequate sealing of the combustion chamber 8 from the atmosphere is provided by an inlet plate portion of its side wall 12*a*.

The web 5 thus pre-dried is then conveyed into the press nip between the suction roll 2 and the heated roll 1, with the linear load between the rolls set to the desired high value. The roll 1 is made of a material of relatively high thermal conductivity and it is so heated that in combination with the loading of the press nip, the web 5 is firmly pressed against the surface of the roll 1. Depending on operating conditions, a large or small amount of steam may be generated in the press nip between the rolls 1 and 2, and a small or large, respectively, amount of steam may be generated over the peripheral segment of the roll 1 enclosed by the hood 11.

Depending on the operating conditions selected, the web 5 is either completely or incompletely dried before it reaches the first doctor blade 9, which doctors it off the web while giving it a creped appearance. The second doctor blade 10 (and any other doctors that may be provided) acts as a cleaning or polishing doctor, as known in the art. The web doctored off the roll 1, as well as the web during starting and temporary shutdown, is collected in the broke chute 12.

While the hood 11 is shown as a simple ventilation hood for the extraction of steam, it can be provided with heat generating means in the form of burners or the like for heating the gaseous medium in the hood and, directly or indirectly, also the web 5 in the region after the nip area. The hood 11 can also form a seal with the heated roll 1 so that steam can be collected without appreciable entry of air for subsequent economical recovery of the heat of evaporation in suitable apparatus. In such case, suction slots may be formed in the inlet and outlet ends of the hood 11 to accommodate a small quantity of surplus steam leakage from the hood to insure that an absolute minimum amount of air is intermixed with the steam that is to be treated subsequently.

The hood 11 may also be provided with seals against the heated roll at its inlet and outlet ends, preferably in the form of roll seals or doctor seals, so as to enable the pressure in the hood to be reduced considerably below atmospheric pressure by extraction of the steam. Lowering the steam pressure in the hood 11 appreciably increases the rate of steam removal from the web and also reduces the amount of heat energy required for drying. This results in a further advantage for certain types of soft creped products, namely, an increase in bulk resulting from a reduction in the internal bonding condition in the paper web 5.

While the burners 6 in FIG. 1 are shown schematically as simple gas burners fed from a common gas supply 7 enclosed by a hood 8, burners for the combustion of fuels other than gas, such as oil or other liquid fuel, two-phase fuel, or pulverized fuel, may be employed. Also, the burners may be made in sections in the machine direction and cross-machine direction in order to provide optimum control of the heat supply and thereby the degree of drying of the web on an average and in cross-machine profile.

Figure 2:
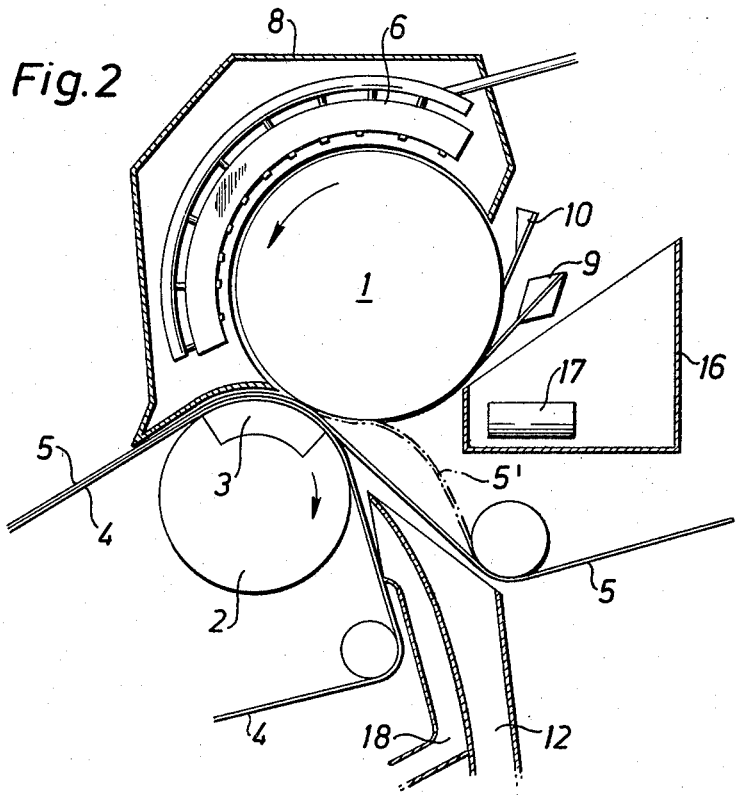
FIG. 2 shows schematically a modification of the apparatus shown in FIG. 1 in which the web runs downwardly out of the press nip.

In the embodiment shown in FIG. 2, the web leaves the heated roll without its structure being changed by creping and, after the press section, is conveyed to means for adjusting its dryness profile to the required uniformity. It differs from the apparatus of FIG. 1 in that the web 5 adhered to the top of the permeable surface (the wire or felt) 4 runs into the press nip between the rolls 1 and 2, which it leaves with a downward motion, as shown in FIG. 2. Accordingly, the combustion chamber 8 with the burner 6 is positioned above the rolls 1, 2. To the extent that the web tends to follow the heated roll 1 to the doctor blades 9, 10, the broke produced thereat will be above the desired web run and must, therefore, be collected on a platform which is usually made in the form of a walkway 16, possibly provided with a conveyor belt 17 for broke removal in the well-known manner.

In operation of the embodiment shown in FIG. 2, the surface of the roll 1 is heated to a high temperature and/or treated with a suitable releasing agent, so that the web tends to come away from the roll at the exit from the press nip between the rolls 1 and 2, or a short distance thereafter, as illustrated by the dashed line 5′ in FIG. 2. Aside from this difference, operation is essentially in the same manner as described above in connection with FIG. 1.

By virtue of the fact that the roll 1 is made of material having good releasing properties and adapted to produce a high temperature in its surface layer, because of its low thermal conductivity, for example, a very high temperature is obtained at the roll surface, which can result in a very rapid, violent, almost explosive generation of steam in the press nip between the rolls. This results in improved drying of the web and improved separation of the web from the heated roll 1.

Figure 3:
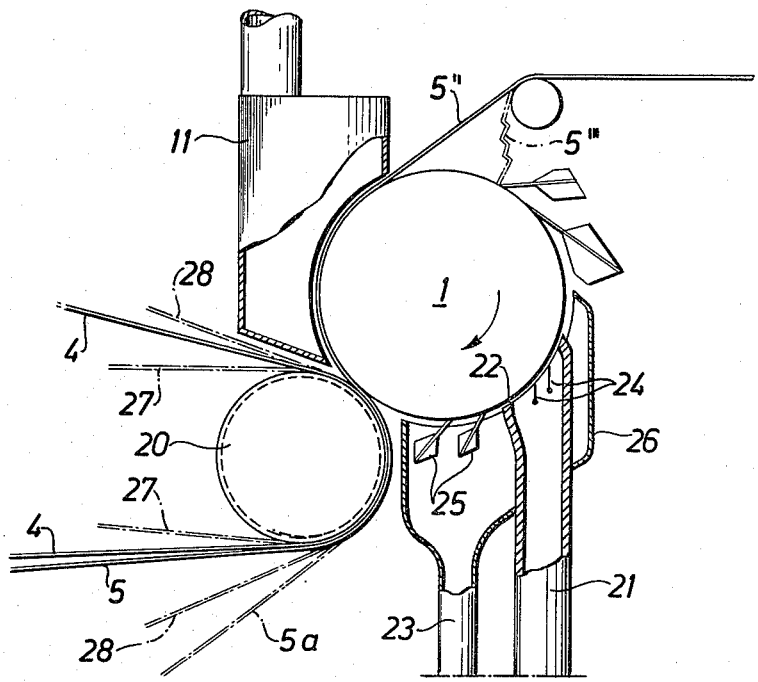
FIG. 3 illustrates schematically another embodiment in which the roll is heated by a liquid medium.

In the embodiment shown in FIG. 3, a hot liquid medium is used for heating the roll 1. To this end, hot liquid is supplied to a duct 21 having an opening at its upper end conformable to the contour of a segment of the roll 1. A moderately tight seal 22 provides sufficient upstream clearance relative to the direction of rotation of the roll to allow the hot liquid to flow over the surface to be heated in the direction opposite its motion. Turbulence generators or other suitable agitating devices 24 are disposed so as to improve the heat transfer from the heating liquid to the roll surface, and one or more doctor blades 25 are positioned to remove heating medium adhering to the roll surface. Excess liquid is collected in a ventilating hood 26 and directed to an outlet 23 for recovery and recirculation. The hood 26 also collects any air and vapors emitted by the heating liquid for cleaning and recovery of heating medium therefrom.

The heating medium may be any liquid that can be brought to the correct temperature without needing to be kept under pressure and without emitting noxious vapors, although some small amount of such vapor can be tolerated if the hood 26 is suitably ventilated. Suitable liquid media may include a heat resistant oil, a liquid metal such as sodium or Wood's metal, or a molten salt.

Since no hot gases are generated in heating the roll 1, a suction roll is not required for pressing the web against the heating roll. However, the web must be conveyed to the press nip on a surface which is sufficiently permeable to allow steam to leave the web without developing high pressure in the sheet which could damage it and impair drying of the web. Accordingly, in FIG. 3 the web is conveyed to the press nip by a felt 4 running over a conventional grooved roll 20 having grooves communicating with the ambient atmosphere.

A wire 27 can also be used instead of or with the grooved roll to ventilate the side of the felt facing away from the sheet. Alternatively, the wire can be part of the permeable surface on which the web runs. It is also possible to use a second wire 28 to convey the web 5*a* to the press nip and to press it onto the heated roll in a so-called knuckle pattern. In this way, the bulk of areas of the web between the knuckles of the wire 28 will be preserved so that the web, after having been doctored off the roll and possibly after being dried and calendered, will become softer and more absorbent than it otherwise would be.

An alternative way of reducing the steam pressure in the felt, thereby facilitating rapid drying of the web (5 or 5'), is to use a smooth surfaced roll and to cool it so that steam passing through the felt condenses on the roll surface and can be removed by doctoring. Such effective cooling can be difficult to attain in a way that is economically justifiable. Therefore, the surface of the roll 20 can be replaced by a belt or wire with substantially the same run as the wire 27 in FIG. 3, which can be cooled effectively in its run in a simple way.

Figure 4:
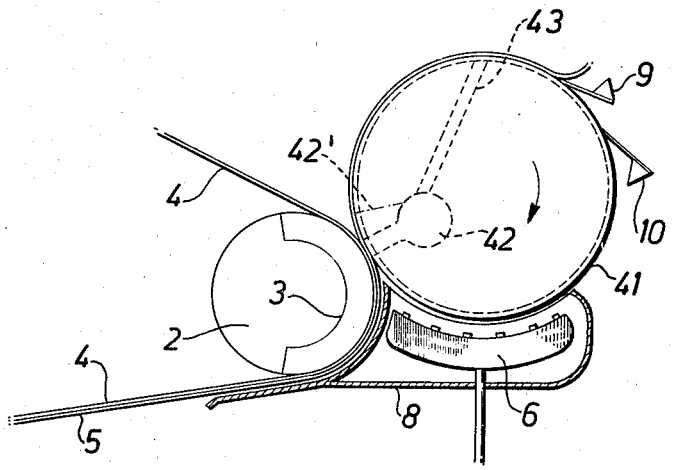
FIG. 4 is a schematic showing of another embodiment in which the heated roll is perforated.

The embodiment shown in FIG. 4 is similar to that illustrated in FIG. 1 except that a heated roll 41 is used which has a perforated surface. The roll surface may be drilled, possibly provided with an overlying, fine mesh, metal sleeve or the like, or made of sintered material. Inside the roll 41 is disposed a stationary steam receiver 42 which is adapted to collect steam pressed out of the sheet. The collected steam can be extracted, possibly at considerable pressure, and conveyed elsewhere for reuse, thus effecting an energy saving.

By moving the steam receiver 42 to a downstream location 42', the steam pressure can be utilized to blow the web loose. Also, the sheet can be loosened at another location on the periphery of the roll 41 by connecting the steam receiver 42 to a blow box 43 located at an arbitrary position.

The invention is, of course, not limited to apparatus in which the web runs substantially horizontally as in FIGS. 1 through 4, but is equally applicable to apparatus in which the web runs substantially vertically upwards or downwards. Further, two or more devices according to the invention can be combined or operated in series. It is also within the scope of the invention to consolidate and/or dry webs of other materials than those usually included in paper and similar products, and even to dry pulverized or finely granulated materials, which can be conveyed to a press nip on a permeable surface according to the invention.

In normal cases, a major part of the drying must take place in the press nip, but the sheet must stick to the roll and the final drying takes place after the nip. Accordingly, the conductivity of the material of which the heating roll is made must be high so as not to dry at temperatures higher than necessary. A high conductivity means that the heat can be conducted to a greater depth in the roll and even extracted from a greater depth, which in itself means that a lower temperature can be used.

On the other hand, if intense drying is required in the press nip, a high temperature is needed at the roll surface. This can be attained either by heating a roll made of high conductivity material to a high temperature, which will involve rather large heat losses through the roll material and the roll ends to the air and the journals, etc., or by using a surface material of low conductivity. The latter should involve lower heat losses and is easier to heat to a high temperature.

However, the choice of material is limited by the risk of thermal fatigue and, in this respect, at least the surface layer of the roll should be made of a material for which the quantity $$\frac{\sigma\mu(1-\nu)\sqrt{\rho c\lambda}}{E\alpha_c}$$

has a high value, desirably at least $0.6\times10^6$, where $\sigma\mu$ is the fatigue strength, $\nu$ is Poisson's ratio, $\rho$ is the density, c is the specific thermal capacity, $\lambda$ is the thermal conductivity, E is the modulus of elasticity, and $\alpha_c$ is the coefficient of thermal expansion for the material. Copper alloys have the highest values, approximately $1.3\times10^6$. However, they have rather poor resistance to wear and are not suitable for doctoring. Other suitable materials are duralumin ($0.7\times10^6$), cast iron ($0.67\times10^6$–$0.85\times10^6$), steel ($0.8\times10^6$), and nickel (approximately $0.8\times10^6$–$0.9\times10^6$).

If heat is supplied to the heated roll by gas burners, a major part of the energy will be emitted in the form of infrared radiation (as opposed to convection). The material of the roll should then have a high absorption coefficient for infrared radiation if all of the heat is to be utilized effectively. A suitable material in this respect is aluminum. The absorption coefficient for infrared radiation should desirably be higher in the temperature range applicable to gas burners (500°–2500° C.) than in the temperature range to be imparted to the paper web (50°–150° C.). In this way, the incoming radiation is utilized effectively and is converted into heat in the roll material, while losses due to radiation to the surroundings are minimized.

Heating of the heated roll has been exemplified above by direct combustion of fuel or by means of a liquid heat carrier brought into contact with the roll. Other methods are also possible. Thus, hot gases for heating the roll can be generated in a separate combustion space by burning a gaseous, liquid or pulverized fuel and then brought against the roll surface. Another possibility is the use of electrical discharges and/or electric resistance losses in wiring against, connected to, or in the surface of the heated roll.

As suggested above in connection with FIG. 2, in certain cases the roll may be heated to a high temperature and/or heat energy may be supplied to the press nip at a high temperature, such that the surface of the web facing the heated roll dries up completely or partially and, therefore, due to the lack of adhesion and/or steam pressure remaining between the web and the roll, releases its hold on the roll directly or shortly after its passage through the press nip. In these cases, release of the web can be facilitated by providing a suitable releasing or lubricating agent. This can be or be included in the medium used to heat the heated roll. For example, a heat resistant oil with suitable releasing and lubricating properties could be used.

The method can be carried out, however, so that the web while still adherent to the heated roll continues to dry but, due to drying stresses present in the web, successively shrinks away from the roll (with or without the aid of a releasing or lubricating agent), whereby the process is terminated before the web is doctored from the surface of the heated roll.

In embodiments like that illustrated in FIG. 1, for handling soft-paper grades, it is desired that the web in the press nip be pressed so hard against the heated roll that it cannot be induced to shrink away therefrom but remains in place until doctored off by a creping doctor. In such cases, the adhesion of the web to the heated roll can suitably be reinforced by means of an additive, which acts as an adhesive, at least at the temperature in the press nip and immediately thereafter. Such additives can be supplied to the surface of the web facing the heated roll or to the surface of the heated roll before it arrives at the press nip, or can be added to the furnish from which the paper is being produced.

The several embodiments described herein are only illustrative and are susceptible of modification in form and detail within the scope of the following claims.

I claim:

1. In a method for consolidating and drying a moist, porous web, the steps of running the web through the nip between a pair of rotatable rolls with one side in contact with one roll and its other side facing a permeable surface pressing the rolls together to develop a high pressure linear load in the press nip sufficient to produce good thermal contact between said one roll and the web at least in areas subjected to said high pressure linear load and to overcome any steam pressure developed between the web and said one roll, supplying heat to the outer surface of said roll as it approaches said nip at a rate such that the roll arrives at said nip with a temperature and heat content high enough to cause moisture in the web to be converted rapidly and violently into steam as the web passes through said nip, and heat is transferred rapidly from the surface of the roll directly to the web under high pressure, the steam thus formed tending to pass straight through the web, carrying with it any free water remaining in the cavities between the fibers of the web, whereby the steam is cooled and practically all of its heat energy is transferred to the web and the water remaining therein.

2. A method as defined in claim 1 in which the web is run through the nip between a rotable roll having a permeable surface and the heated surface of said one roll.

3. A method as defined in claim 1 in which the web is run through the nip between said rolls on a permeable belt with one side of the web in contact with said heated roll.

4. A method as defined in claim 2 in which the web is run through the nip between a roll having a grooved surface and a second roll, the surface of which is heated as it approaches said nip.

5. A method as defined in one of claims 2 and 3 in which the web is run through the nip between a pair of rotatable rolls, one of which is a suction roll, with one side facing said suction roll and its other side in contact with the surface of the other roll.

6. A method as defined in claim 1 in which the web is consolidated and dried on the heated roll and is then removed therefrom by doctoring.

7. A method as defined in claim 1 in which said one roll is heated by combustion of a fuel in close proximity to the surface thereof.

8. A method as defined in claim 7 in which hot gases produced by combustion of said fuel are flowed against the surface of said heated roll as it approaches said nip.

9. A method as defined in claim 8 in which part of the hot gases produced by combustion of said fuel are flowed through the web, thereby supplying heat to the latter.

10. A method as defined in claim 1 in which said one roll is heated by exposing part of the surface thereof to a liquid heating medium.

11. A method as defined in claim 10 in which the liquid medium is a heat resistant oil.

12. A method as defined in claim 10 in which the liquid medium is a molten metal.

13. A method as defined in claim 10 in which the liquid medium is a molten salt.

14. A method as defined in claim 10 in which the liquid medium is flowed against the surface of the heated roll.

15. A method as defined in claim 14 in which the principal direction of flow of the liquid is opposite the direction of travel of the roll surface.

16. A method as defined in claim 1 in which the pressure in the press nip lies in the range of 0.1–5 $MN/m^2$.

17. Apparatus for consolidating and drying a moist, porous web of material comprising:

a pair of rotatable rolls defining a nip;

means for running the web through said nip with one side in contact with the surface of one of said rolls and with the other side facing a permeable surface;

heating means disposed externally of said one roll for supplying heat to a portion of the outer surface thereof as it approaches said nip so that said surface portion is brought to a temperature and heat content high enough to cause the moisture in the web to be converted suddenly and violently into steam as the web passes through said nip, said heating means including conduit means having outlet means generally conforming to the shape of part of said one roll in closely adjacent relation to the surface thereof and disposed upstream of said nip, and means for supplying a liquid heating medium to said conduit means; and means for pressing said rolls together so that a load is created which is sufficient to overcome any steam pressure developed between the web and said one roll in the nip area and sufficient to produce good thermal contact between the web and said one roll in said nip area, whereby heat is transferred rapidly from the surface of the roll directly to the web under high pressure, at least in said nip area.

18. Apparatus as defined in claim 17 together with means providing clearance between said outlet means and the adjacent surface of said one roll on the upstream side of said outlet means for flowing liquid therethrough in a direction opposite the direction of motion of said one roll.

* * * * *